US010266911B2

(12) United States Patent
Hayashi et al.

(10) Patent No.: US 10,266,911 B2
(45) Date of Patent: Apr. 23, 2019

(54) HOT-FORMED MEMBER AND MANUFACTURING METHOD OF SAME

(71) Applicant: NIPPON STEEL & SUMITOMO METAL CORPORATION, Tokyo (JP)

(72) Inventors: Koutarou Hayashi, Suita (JP); Akira Seki, Ashiya (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 285 days.

(21) Appl. No.: 15/109,322

(22) PCT Filed: Jan. 6, 2014

(86) PCT No.: PCT/JP2014/050027
§ 371 (c)(1),
(2) Date: Jun. 30, 2016

(87) PCT Pub. No.: WO2015/102051
PCT Pub. Date: Jul. 9, 2015

(65) Prior Publication Data
US 2016/0319389 A1 Nov. 3, 2016

(51) Int. Cl.
*C22C 38/00* (2006.01)
*C21D 9/46* (2006.01)
(Continued)

(52) U.S. Cl.
CPC ..... *C21D 9/46* (2013.01); *C21D 1/185* (2013.01); *C21D 6/002* (2013.01); *C21D 6/005* (2013.01);
(Continued)

(58) Field of Classification Search
CPC ..... C21D 9/46; C21D 1/185; C21D 6/002; C21D 6/005; C21D 6/008; C21D 8/0205;
(Continued)

(56) References Cited

U.S. PATENT DOCUMENTS 4,854,976 A 8/1989 Era et al.
2004/0238082 A1 12/2004 Hasegawa et al.
(Continued)

FOREIGN PATENT DOCUMENTS

CA 2770585 A1 2/2011
CA 2923582 A1 3/2015
(Continued)

OTHER PUBLICATIONS

Notice of Allowance dated Nov. 23, 2017, in Korean Patent Application No. 10-2016-7018726, with English translation.
(Continued)

*Primary Examiner* — Patricia L. Hailey
(74) *Attorney, Agent, or Firm* — Birch, Stewart, Kolasch & Birch, LLP

(57) ABSTRACT

Provided is a hot-formed member according to the present invention, having a predetermined chemical composition and having a metallographic microstructure containing austenite at an area ratio of 10 area % to 40 area % and in which total number density of particles of the austenite and martensite is equal to or greater than 1.0 number/$\mu m^2$, in which tensile strength is from 900 MPa to 1300 MPa.

10 Claims, 1 Drawing Sheet

(51) Int. Cl.

| | |
|---|---|
| ***C21D 8/02*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/26*** | (2006.01) |
| ***C22C 38/28*** | (2006.01) |
| ***C22C 38/34*** | (2006.01) |
| ***C22C 38/38*** | (2006.01) |
| ***C21D 6/00*** | (2006.01) |
| ***C21D 1/18*** | (2006.01) |

(52) U.S. Cl.

CPC ..... *C21D 6/008* (2013.01); *C21D 8/0205* (2013.01); *C21D 8/0263* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/26* (2013.01); *C22C 38/28* (2013.01); *C22C 38/34* (2013.01); *C22C 38/38* (2013.01); *C21D 2211/001* (2013.01); *C21D 2211/002* (2013.01); *C21D 2211/008* (2013.01)

(58) Field of Classification Search

CPC ..... C21D 8/0263; C21D 2211/001; C21D 2211/002; C21D 2211/008; C22C 38/00; C22C 38/001; C22C 38/002; C22C 38/005; C22C 38/02; C22C 38/04; C22C 38/06; C22C 38/08; C22C 38/12; C22C 38/14; C22C 38/16; C22C 38/26; C22C 38/34; C22C 38/38

USPC ..... 148/654

See application file for complete search history.

(56) References Cited

U.S. PATENT DOCUMENTS

| | | | | |
|---|---|---|---|---|
| 2008/0308194 | A1 | 12/2008 | Corquillet et al. | |
| 2009/0098408 | A1 | 4/2009 | Sun | |
| 2010/0000636 | A1* | 1/2010 | Bonnefois | C21D 8/0226 148/541 |
| 2011/0198002 | A1 | 8/2011 | Nakagaito et al. | |
| 2011/0308673 | A1 | 12/2011 | Schneider et al. | |
| 2011/0315279 | A1 | 12/2011 | Kaneko et al. | |
| 2012/0012231 | A1 | 1/2012 | Murakami et al. | |
| 2012/0186707 | A1 | 7/2012 | Hirasawa et al. | |
| 2012/0211128 | A1 | 8/2012 | Corquillet et al. | |
| 2012/0291928 | A1 | 11/2012 | Celotto | |
| 2013/0095347 | A1 | 4/2013 | Kawasaki et al. | |
| 2013/0133792 | A1 | 5/2013 | Nakagaito et al. | |
| 2014/0096876 | A1 | 4/2014 | Matsuda et al. | |
| 2015/0030880 | A1* | 1/2015 | Kosaka | C22C 38/001 428/659 |
| 2015/0034037 | A1* | 2/2015 | Qiao | C21D 5/00 123/188.8 |

FOREIGN PATENT DOCUMENTS

| | | | | | |
|---|---|---|---|---|---|
| CA | 2923583 | A1 | | 3/2015 | |
| CA | 2923585 | A1 | | 3/2015 | |
| CA | 2933435 | A1 | | 6/2015 | |
| CA | 2934597 | A1 | | 7/2015 | |
| CA | 2934599 | A1 | | 7/2015 | |
| CA | 2935638 | A1 | | 7/2015 | |
| CN | 101292049 | A | | 10/2008 | |
| CN | 101638749 | A | | 2/2010 | |
| CN | 102149840 | A | | 8/2011 | |
| CN | 102906291 | A | | 1/2013 | |
| EP | 1767659 | A1 | | 3/2007 | |
| EP | 2778247 | A1 | | 9/2014 | |
| EP | 2824204 | A1 | | 1/2015 | |
| EP | 3075872 | A1 | | 10/2016 | |
| GB | 1 490 535 | A | | 11/1977 | |
| JP | 7-3328 | A | | 1/1995 | |
| JP | 10-96031 | A | | 4/1998 | |
| JP | 2003-138345 | A | | 5/2003 | |
| JP | 2004-269920 | A | | 9/2004 | |
| JP | 2005139485 | A | * | 6/2005 | B21D 22/02 |
| JP | 2005-205477 | A | | 8/2005 | |
| JP | 2005-248320 | A | | 9/2005 | |
| JP | 2006-70346 | A | | 3/2006 | |
| JP | 2006-131958 | A | | 5/2006 | |
| JP | 2007-327123 | A | | 12/2007 | |
| JP | 2009-508692 | A | | 3/2009 | |
| JP | 2010-65292 | A | | 3/2010 | |
| JP | 2010-65295 | A | | 3/2010 | |
| JP | 2010-90475 | A | | 4/2010 | |
| JP | 2010-126770 | A | | 6/2010 | |
| JP | 2013-185243 | A | | 6/2010 | |
| JP | 2010-150612 | A | | 7/2010 | |
| JP | 2010-196115 | A | | 9/2010 | |
| JP | 2011-184758 | A | | 9/2011 | |
| JP | 2011-195956 | A | | 10/2011 | |
| JP | 2012-180594 | A | | 9/2012 | |
| JP | 2013-163827 | A | | 8/2013 | |
| JP | 2014-19941 | A | | 2/2014 | |
| JP | 2014-25091 | A | | 2/2014 | |
| RU | 2 499 847 | C2 | | 8/2011 | |
| RU | 2 499 847 | C2 | | 2/2012 | |
| WO | WO 2012/147898 | A1 | | 11/2012 | |
| WO | WO 2013/061545 | A1 | | 5/2013 | |
| WO | WO 2013/069937 | A1 | | 5/2013 | |
| WO | WO 2013/105633 | A1 | | 7/2013 | |
| WO | WO 2013/125400 | A1 | | 8/2013 | |
| WO | WO 2013/129049 | A1 | | 9/2013 | |
| WO | WO 2013/133165 | A1 | | 9/2013 | |

OTHER PUBLICATIONS

Office Action dated Jan. 30, 2018, in Russian Patent Application No. 2016128754/02, with English translation.

Chinese Office Action and Search Report dated Mar. 6, 2017, for Chinese Application No. 201480072216.7, with an English translation.

Canadian Office Action issued in Canadian Application No. 2,935,308, dated Apr. 18, 2017.

Korean Office Action issued in Korean Application No. 10-2016-7018726, dated Apr. 27, 2017, together with an English translation.

Furukawa et al., "Journal of the Japan Society for Heat Treatment", 1997, vol. 37, No. 4, pp. 204-211, total 21 pages.

International Search Report for PCT/JP2014/050027 dated Apr. 8, 2014.

Office Action for TW 103100371 dated Mar. 16, 2015.

Written Opinion of the International Searching Authority for PCT/JP2014/050027 (PCT/ISN237) dated Apr. 8, 2014.

Extended European Search Report issued in European Application No. 14876913.6 dated Jul. 25, 2017.

Chinese Office Action and Search Report, dated Feb. 22, 2017, for Chinese Application No. 201480072212.9, with an English translation of the Search Report.

Extended European Search Report for European Application No. 14876061.4, dated Jun. 28, 2017.

International Search Report for PCT/JP2014/050022 dated Mar. 25, 2014.

Korean Notice of Preliminary Rejection dated Apr. 27, 2017, for Korean Application No. 10-2016-7017724, with English translation.

Office Action for TW 103100367 dated Jan. 12, 2015.

U.S. Office Action for copending U.S. Appl. No. 15/109,586, dated Jul. 12, 2018.

(56) References Cited

OTHER PUBLICATIONS

Written Opinion of the International Searching Authority for PCT/JP2014/050022 (PCT/ISA/237) dated Mar. 25, 2014.

* cited by examiner

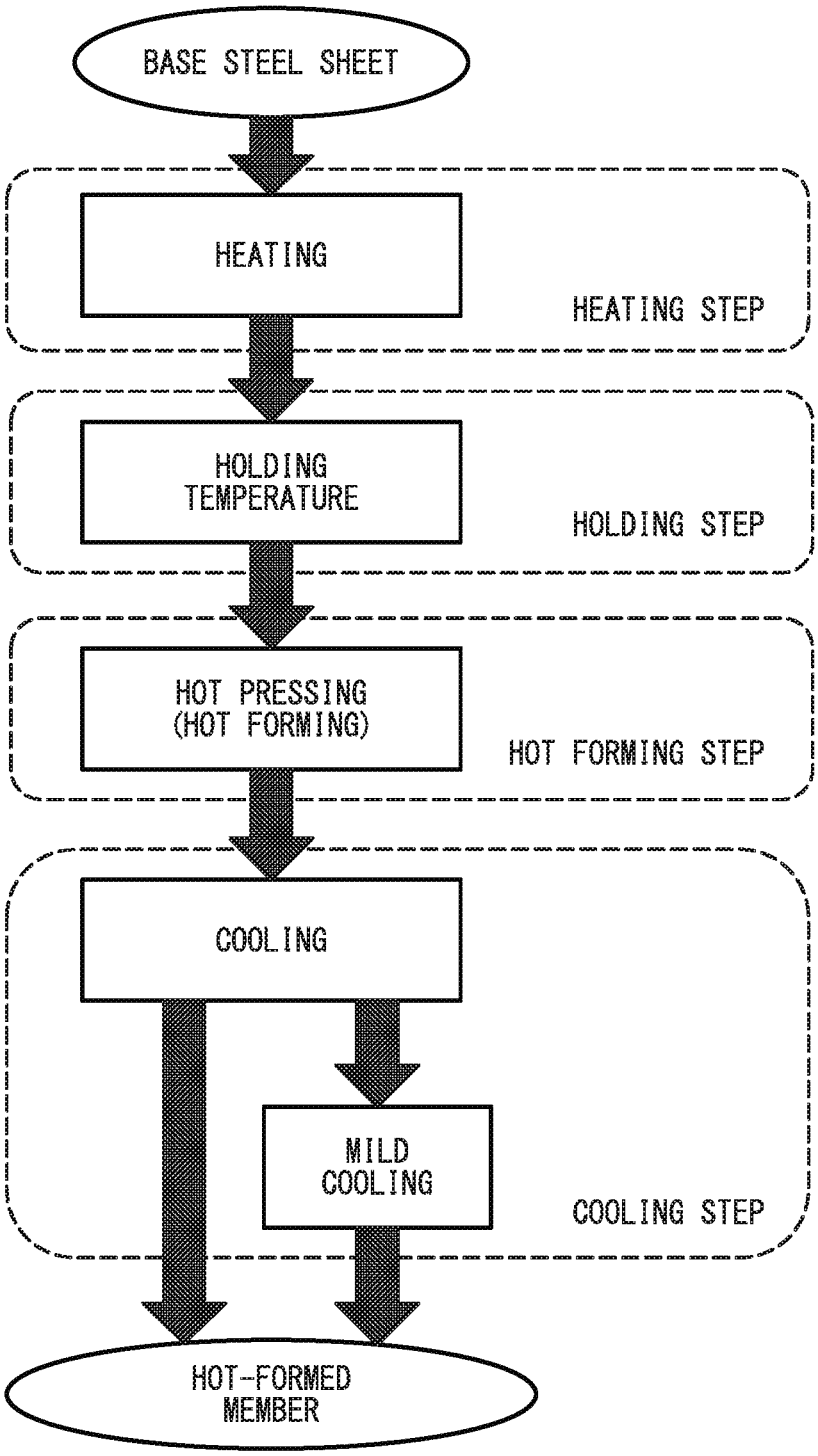
BASE STEEL SHEET
HEATING
HEATING STEP
HOLDING TEMPERATURE
HOLDING STEP
HOT PRESSING (HOT FORMING)
HOT FORMING STEP
COOLING
MILD COOLING
COOLING STEP
HOT-FORMED MEMBER

HOT-FORMED MEMBER AND MANUFACTURING METHOD OF SAME

TECHNICAL FIELD OF THE INVENTION

The present invention relates to a hot-formed member used in mechanical structure components such as body structure components and underbody components of a vehicle, for example, and a manufacturing method thereof. Specifically, the present invention relates to a hot-formed member having excellent ductility in which the total elongation obtained by a tensile test is equal to or greater than 15% while maintaining a tensile strength of 900 MPa to 1300 MPa, and excellent impact properties in which an impact value obtained by a Charpy test at 0° C. is equal to or greater than 20 J/cm$^2$, and a manufacturing method thereof.

RELATED ART

In recent years, in order to reduce the weight of a vehicle, efforts to reduce the weight of steel products used by realizing high-strengthening of the steel products used in a car body have been made. In steel sheets which are widely used in technical fields relating to vehicles, press formability has decreased due to an increase in the strength of the steel sheets, and accordingly, it is difficult to manufacture a member having a complicated shape. Specifically, ductility of the steel sheets is decreased due to an increase in the strength of the steel sheets, and accordingly, breaking occurs in a region of the member subjected to working with high working ratio and/or springback and wall warp of the member becomes significantly large and causes deterioration in the shape accuracy of the member. Therefore, it is not easy to manufacture a member having a complicated shape by applying press forming to a steel sheet having high strength, particularly a tensile strength equal to or greater than the level of 900 M Pa. According to roll forming instead of the press forming, a steel sheet having high strength can be worked, but the roll forming can only be applied to a manufacturing method of a member having a uniform cross section in a longitudinal direction.

Meanwhile, as disclosed in Patent Document 1, in a method called hot pressing of performing press forming of a heated steel sheet, it is possible to form a member having a complicated shape from a high-strength steel sheet with excellent shape accuracy. This is because, in the hot pressing step, the steel sheet is worked in a state of being heated at a high temperature, and thus the steel sheet at the time of working is softened and has high ductility. In the hot pressing, it is also possible to obtain a high strength member by martensitic transformation, by heating the steel sheet to an austenite single phase region before the pressing and rapidly cooling (quenching) the steel sheet in a die after the pressing. Therefore, the hot pressing method is an excellent forming method which secures the high strength of the member and the formability of the steel sheet at the same time.

Patent Document 2 discloses a pre-press quenching method for obtaining a high strength member by forming a steel sheet in a predetermined shape at room temperature, heating the obtained member to an austenite region, and rapidly cooling the member in a die. In the pre-press quenching method which is one embodiment of the hot pressing, it is possible to prevent deformation of a member due to distortion by heating, with restraining the member by the die. The pre-press quenching method is an excellent forming method for achieving high strength of a member and high shape accuracy.

However, in recent years, excellent impact absorbing properties are also required to be achieved in the hot-formed member. That is, it is required that both excellent ductility and excellent impact properties are achieved in the hot-formed member. It is difficult to achieve such requirements by technologies in the related art represented by Patent Document 1 and Patent Document 2. This is because the metallographic microstructure of a member obtained by technologies in the related art has substantially a martensite single phase.

Therefore, Patent Document 3 discloses a technology of obtaining a member having high strength and excellent ductility by heating a steel sheet to a dual-phase temperature region of a ferrite and an austenite to perform pressing of the steel sheet in a state where the metallographic microstructure of the steel sheet has a ferrite-martensite dual phase microstructure, rapid cooling the steel sheet in a die, and changing the metallographic microstructure of the steel sheet into a ferrite-austenite dual phase microstructure. However, since elongation of the member obtained by the technology is equal to or smaller than approximately 10%, the ductility of the member disclosed in Patent Document 3 is not sufficiently high. It is necessary that such a member which is required in the technical field related to vehicles and required to have excellent impact absorbing properties has better ductility than the member described above, specifically, has an elongation equal to or greater than 15%. The elongation thereof is preferably equal to or greater than 18% and is more preferably equal to or greater than 21%.

It is possible to significantly increase the ductility of a member obtained by the hot pressing method by applying a microstructure control method for transformation induced plasticity steel (TRIP steel) and quench & partitioning steel (Q&P steel) to the hot pressing method. This is because the residual austenite is generated in the metallographic microstructure of the member due to a specific thermal treatment which will be described later.

Patent Document 4 discloses a technology of obtaining a member having high strength and excellent ductility by heating a steel sheet obtained by actively adding Si and Mn to a dual-phase temperature region of a ferrite and an austenite in advance, performing press-forming and rapid cooling simultaneously with respect to the steel sheet using a deep drawing apparatus, to transform the metallographic microstructure of the obtained member into a complex-phase microstructure containing ferrite, martensite, and austenite. It is necessary to perform an isothermal holding treatment at 300° C. to 400° C., that is, an austempering treatment with respect to the steel sheet, in order to cause austenite to be contained in the metallographic microstructure of the member. Accordingly, it is necessary that a die of the deep drawing apparatus in Patent Document 4 is heated at 300° C. to 400° C. In addition, as disclosed in examples of Patent Document 4, it is necessary that the member be held in a die for approximately 60 seconds. However, in a case of performing the austempering treatment, not only the tensile strength of the steel sheet, but also the elongation of the steel sheet significantly changes depending on the holding temperature and the holding time. Accordingly, in a case of performing the austempering treatment, it is difficult to ensure stable mechanical properties. In a case of performing the austempering treatment with respect to a steel containing a large amount of Si, such as a kind of steel corresponding to a target of the present invention, a significantly hard martensite is easily generated in the metallographic microstructure and the impact properties of the member is significantly deteriorated due to this martensite.

Patent Document 5 discloses a technology of obtaining a member having high strength and excellent ductility by heating a steel sheet obtained by actively adding Si and Mn to a dual-phase temperature region or an austenite single-phase region in advance, performing forming and rapid cooling to a predetermined temperature with respect to the steel sheet at the same time, and heating the obtained member again, to change the metallographic microstructure of the member into a complex-phase microstructure containing martensite and austenite. However, in the manufacturing method by the technology described above, the tensile strength of the member significantly changes depending on a rapid-cooling condition, specifically, a temperature at which the cooling stops. A problem in a step such as significant difficulty in controlling a cooling stop temperature is inevitable in the manufacturing method described above. Unlike the manufacturing method of the hot-formed member of the related art, it is necessary that a further heat treatment step such as re-heating is performed in the manufacturing method disclosed in Patent Document 5. Therefore, in the manufacturing method disclosed in Patent Document 5, the productivity is significantly low, compared to that in the manufacturing method of the hot-formed member of the related art. In addition, as disclosed in examples of Patent Document 5, it is necessary to heat the steel sheet at a high temperature in the manufacturing method disclosed in Patent Document 5, and accordingly, second phases such as martensite are sparsely distributed in the metallographic microstructure of the member. This causes a problem such as a significant deterioration in the impact properties of the member.

Thus, it is necessary to newly investigate a hot forming method of obtaining a steel sheet member containing residual austenite, without using a microstructure controlling method for the TRIP steel and the Q&P steel.

Meanwhile, a steel which has both of excellent strength and excellent ductility is obtained by performing a heat treatment with respect to a low carbon steel obtained by actively adding Mn at the vicinity of $A_1$ temperature. For example, Non-Patent Document 1 discloses a steel containing several tens % of residual austenite and having high strength and excellent ductility, which is obtained by performing hot rolling of a 0.1% C-5% Mn alloy and further performing re-heating.

PRIOR ART DOCUMENT

Patent Document

[Patent Document 1] Great Britain Patent No. 1490535

[Patent Document 2] Japanese Unexamined Patent Application, First Publication No. H10-96031

[Patent Document 3] Japanese Unexamined Patent Application, First Publication No. 2010-65292

[Patent Document 4] Published Japanese Translation No. 2009-508692 of the PCT International Publication

[Patent Document 5] Japanese Unexamined Patent Application, First Publication No. 2011-184758

Non-Patent Document

[Non-Patent Document 1] Journal of the Japan Society for Heat Treatment, Vol. 37 No. 4 (1997), p. 204

DISCLOSURE OF THE INVENTION

Problems to be Solved by the Invention

Like the method disclosed in Non-Patent Document 1, it is possible to manufacture a hot-formed member containing residual austenite, by optimizing a chemical composition of the hot-formed member and strictly controlling the heat treatment temperature in the hot forming step at the vicinity of $A_1$ temperature. However, in the method disclosed in Non-Patent Document 1, the heating time significantly affects the tensile strength and the elongation. It is necessary to perform the heating for 30 minutes or longer, in order to limiting a change in the obtained tensile strength and elongation. Such a microstructure controlling operation by performing the heating for a long period of time cannot be applied to a production technology of a hot-formed member, when considering the productivity and surface quality of a member. In addition, in the method disclosed in Non-Patent Document 1, cementite tends to be hardly dissolved, and accordingly, it is easily assumed that the impact properties of the hot-formed member obtained by this technology are not sufficient.

As described above, a mass production technology of providing a member which is manufactured by the hot forming, has a tensile strength equal to or greater than 900 MPa, and has excellent ductility and impact properties has not yet been established.

The present invention is to provide a hot-formed member having a tensile strength equal to or greater than 900 MPa and having excellent ductility and impact properties, which could not be mass-produced in the related art as described above, and a manufacturing method thereof.

Means for Solving the Problem

The inventors have conducted extensive studies in order to improve the ductility and impact properties of a hot-formed member having a tensile strength equal to or greater than 900 MPa, and have found that ductility and impact properties of the hot-formed member are significantly improved by (1) increasing the Si content in the hot-formed member to be higher than that of a typical steel sheet for hot forming, and (2) changing a metallographic microstructure of the hot-formed member into the metallographic microstructure in which a predetermined amount of austenite is contained and fine austenite and fine martensite are entirely present. In addition, the inventors found that such a metallographic microstructure is achieved by using a base steel sheet having the same chemical composition as the chemical composition of the hot-formed member described above and having a metallographic microstructure in which one or both of bainite and martensite are contained and in which particles of cementite are present at a predetermined number density, as a raw material of a hot-formed member, and optimizing the heat treatment conditions at the time of the hot forming.

The present invention is made based on the above-mentioned findings and details are as follows.

(1) An aspect of the present invention is a hot-formed member having a chemical composition comprising, by mass %, C: 0.05% to 0.40%, Si: 0.5% to 3.0%, Mn: 1.2% to 8.0%, P: 0.05% or less, S: 0.01% or less, sol. Al: 0.001% to 2.0%, N: 0.01% or less, Ti: 0% to 1.0%, Nb: 0% to 1.0%, V: 0% to 1.0%, Cr: 0% to 1.0%, Mo: 0% to 1.0%, Cu: 0% to 1.0%, Ni: 0% to 1.0%, Ca: 0% to 0.01%, Mg: 0% to 0.01%, REM: 0% to 0.01%, Zr: 0% to 0.01%, B: 0% to 0.01%, Bi:

0% to 0.01%, and the balance of Fe and impurities, wherein the hot-formed member has a metallographic microstructure which contains an austenite of 10 area % to 40 area % and in which the total number density of particles of the austenite and particles of a martensite is equal to or greater than 1.0 piece/$\mu m^2$, and wherein a tensile strength is 900 MPa to 1300 MPa.

(2) In the hot-formed member according to (1), the chemical composition may include one or two or more selected from the group consisting of by mass %, Ti: 0.003% to 1.0%, Nb: 0.003% to 1.0%, V: 0.003% to 1.0%, Cr: 0.003% to 1.0%, Mo: 0.003% to 1.0%, Cu: 0.003% to 1.0%, and Ni: 0.003% to 1.0%.

(3) In the hot-formed member according to (1) or (2), the chemical composition may include one or two or more selected from the group consisting of, by mass %, Ca: 0.0003% to 0.01%, Mg: 0.0003% to 0.01%, REM: 0.0003% to 0.01%, and Zr: 0.0003% to 0.01%.

(4) In the hot-formed member according to any one of (1) to (3), the chemical composition may include, by mass %, B: 0.0003% to 0.01%.

(5) In the hot-formed member according to any one of (1) to (4), the chemical composition may include, by mass %, Bi: 0.0003% to 0.01%.

(6) Another aspect of the present invention is a manufacturing method of a hot-formed member including: heating a base steel sheet having a chemical composition which is same as the chemical composition of the hot-formed member according to any one of (1) to (5) and in which a Mn content is 2.4 mass % to 8.0 mass %, and having a metallographic microstructure in which the total area ratio of one or both of a bainite and a martensite is equal to or greater than 70 area %, and particles of a cementite are present at a number density equal to or greater than 1.0 number/$\mu m^2$, to a temperature region which is equal to or higher than 670° C. and lower than 780° C. and is lower than an $Ac_3$ temperature; then holding the temperature of the base steel sheet in the temperature region which is equal to or higher than 670° C. and lower than 780° C. and is lower than an $Ac_3$ temperature for 2 minutes to 20 minutes; then performing a hot forming with respect to the base steel sheet; and then cooling the base steel sheet under conditions in which an average cooling rate in a temperature region of 600° C. to 150° C. is from 5° C./sec to 500° C./sec.

(7) Still another aspect of the present invention is a manufacturing method of a hot-formed member including: heating a base steel sheet having a chemical composition which is same as the chemical composition of the hot-formed member according to any one of (1) to (5) and in which a Mn content is equal to or more than 1.2 mass % and less than 2.4 mass %, and having a metallographic microstructure in which the total area ratio of one or both of a bainite and a martensite is equal to or greater than 70 area %, and particles of a cementite are present at a number density equal to or greater than 1.0 number/$\mu m^2$, to a temperature region which is equal to or higher than 670° C. and lower than 780° C. and is lower than an $Ac_3$ temperature; then holding the temperature of the base steel sheet in the temperature region which is equal to or higher than 670° C. and lower than 780° C. and is lower than an $Ac_3$ temperature for 2 minutes to 20 minutes; then performing a hot forming with respect to the base steel sheet; and then cooling the base steel sheet under conditions in which an average cooling rate in a temperature region of 600° C. to 500° C. is from 5° C./sec to 500° C./sec and the average cooling rate in a temperature region lower than 500° C. and equal to or higher than 150° C. is from 5° C./sec and 20° C./sec.

Effects of the Invention

According to the present invention, effects having technical advantage in which a hot-formed member having a tensile strength equal to or greater than 900 MPa, having excellent ductility, and having excellent impact properties can be practicalized for practical use are achieved.

BRIEF DESCRIPTION OF THE DRAWING

FIG. 1 is a flowchart showing a manufacturing method according to the present invention.

EMBODIMENT OF THE INVENTION

Hereinafter, a hot-formed member according to one embodiment of the present invention and a manufacturing method thereof, which are achieved based on the findings described above will be described. In the following description, as the hot forming, hot pressing which is a specific embodiment will be described as an example. However, a forming method other than the hot pressing, such as, for example, roll forming may be used as the hot forming method, as long as manufacturing conditions which are substantially the same as the manufacturing conditions disclosed in the following description are achieved.

1. Chemical Composition

First, a chemical composition of the hot-formed member according to one embodiment of the present invention will be described. In the following description, "%" representing the amount of each alloy element means "mass %", unless otherwise stated. The chemical composition of steel does not change even when the hot forming is performed, and therefore, the amount of each element in a base steel sheet before being subjected to the hot forming is equivalent to the amount of each element in a hot-formed member after the hot forming.

(C: 0.05% to 0.40%)

C is a significantly important element which increases the hardenability of steel and most strongly affects the strength of a hot-formed member after quenching. When the C content is less than 0.05%, it is difficult to ensure the tensile strength equal to or greater than 900 MPa after quenching. Therefore, the C content is set to be equal to or more than 0.05%. Meanwhile, when the C content exceeds 0.40%, impact properties of the hot-formed member are significantly deteriorated. Therefore, the C content is set to be equal to or less than 0.40%. The C content is preferably equal to or less than 0.25%, in order to improve weldability of the hot-formed member. The C content is preferably equal to or more than 0.08%, in order to stably ensure the strength of the hot-formed member.

(Si: 0.5% to 3.0%)

Si is an element which is significantly effective for stably ensuring the strength of steel after quenching. In addition, the amount of austenite in a metallographic microstructure increases and ductility of the hot-formed member is improved by adding Si. When the Si content is less than 0.5%, it is difficult to obtain the above-mentioned effects. Particularly, in the embodiment, when the amount of austenite is insufficient, necessary ductility is not obtained, and accordingly, it is extremely disadvantageous for industrial application. Thus, the Si content is set to be equal to or more than 0.5%. When the Si content is equal to or more than 1.0%, the ductility is further improved. Therefore, the Si content is preferably equal to or more than 1.0%. Meanwhile, when the Si content exceeds 3.0%, it is economically disadvantageous due to saturated effects obtained by the actions described above and surface quality of the hot-formed member is significantly deteriorated. Therefore, the Si content is set to be equal to or less than 3.0%. The Si content is preferably equal to or less than 2.5% in order to more properly prevent a deterioration in surface quality of the hot-formed member.

(Mn: 1.2% to 8.0%)

Mn is an element which is significantly effective for increasing the hardenability of steel and stably ensuring the strength of steel after quenching. In addition, Mn is also effective for increasing ductility of the hot-formed after quenching. However, when the Mn content is less than 1.2%, these effects are not sufficiently obtained and it is significantly difficult to ensure the tensile strength equal to or greater than 900 MPa after quenching. Therefore, the Mn content is set to be equal to or more than 1.2%. When the Mn content is equal to or more than 2.4%, the ductility of the hot-formed member is further increased, and accordingly mild cooling after hot forming which will be described later is not a necessary a manufacturing step and productivity is significantly improved. Therefore, the Mn content is preferably equal to or more than 2.4%. Meanwhile, when the Mn content exceeds 8.0%, austenite is excessively generated in the hot-formed member and delayed fracture easily occurs. Therefore, the Mn content is set to be equal to or less than 8.0%. When the tensile strength of the base steel sheet before applying the hot forming is decreased, productivity in a hot forming step which will be described later is improved. In order to obtain this effect, the Mn content is preferably equal to or less than 6.0%.

(P: 0.05% or Less)

P is generally an impurity unavoidably contained in steel. However, in the embodiment, P has an effect on increasing strength of steel by solid solution strengthening, and accordingly P may be actively contained. However, when the P content exceeds 0.05%, the weldability of the hot-formed member may be significantly deteriorated. Therefore, the P content is set to be equal to or less than 0.05%. The P content is preferably equal to or less than 0.02%, in order to more properly prevent a deterioration in weldability of the hot-formed member. The P content is preferably equal to or more than 0.003%, in order to more properly obtain the above-mentioned strength improvement action. However, even when the P content is 0%, properties which are necessary for solving the problems can be obtained, and therefore, a lower limit value of the P content is not necessary to be specified. That is, the lower limit value of the P content is 0%.

(S: 0.01% or Less)

S is an impurity contained in steel and it is preferable that a S content is as small as possible, in order to improve weldability. When the S content exceeds 0.01%, weldability is significantly decreased to an unacceptable level. Therefore, the S content is set to be equal to or less than 0.01%. The S content is preferably equal to or less than 0.003% and more preferably equal to or less than 0.0015%, in order to more properly prevent a decrease in weldability. Since it is preferable that the S content is as small as possible, a lower limit value of the S content is not necessary to be specified. That is, the lower limit value of the S content is 0%.

(sol. Al: 0.001% to 2.0%)

sol. Al indicates solution Al present in steel in a solid solution state. Al is an element which has an effect on deoxidation of steel and is also an element which prevents oxidization of carbonitride forming elements such as Ti and promotes the forming of carbonitride. With such effects, it is possible to prevent generation of surface defects in a steel and improve the manufacturing yield of the steel. When the sol. Al content is less than 0.001%, it is difficult to obtain the effects described above. Therefore, the sol. Al content is set to be equal to or more than 0.001%. The sol. Al content is preferably equal to or more than 0.01%, in order to more properly obtain the effects described above. Meanwhile, when the sol. Al content exceeds 2.0%, weldability of the hot-formed member is significantly decreased, the amount of oxide-based inclusions is increased in the hot-formed member, and the surface quality of the hot-formed member is significantly deteriorated. Therefore, the sol. Al content is set to be equal to or less than 2.0%. The sol. Al content is preferably equal to or less than 1.5%, in order to more properly avoid the phenomenon described above.

(N: 0.01% or Less)

N is an impurity unavoidably contained in steel and the N content is preferably as small as possible, in order to improve the weldability. When the N content exceeds 0.01%, weldability of a hot-formed member is significantly decreased to an unacceptable level. Therefore, the N content is set to be equal to or less than 0.01%. The N content is preferably equal to or less than 0.006%, in order to more properly avoid a decrease in weldability. Since it is preferable that the N content is as small as possible, the lower limit value of the N content is not necessary to be specified. That is, the lower limit of the N content is 0%.

The chemical composition of the hot-formed member according to the embodiment includes the balance of Fe and impurities. The impurities are components mixed from raw materials such as ores or scraps when industrially manufacturing a steel or due to various reasons of the manufacturing step and means components allowed to be contained in a range not negatively affecting the properties of the hot-formed member according to the embodiment. However, the hot-formed member according to the embodiment may further contain the following elements as arbitrary components. Even when the following arbitrary elements are not contained in the hot-formed member, properties which are necessary for solving the problems can be obtained, and therefore, a lower limit value of the arbitrary element content is not necessary to be specified. That is, the lower limit value of the arbitrary element content is 0%.

(One or Two or More Selected from Group Consisting of Ti: 0% to 1.0%, Nb: 0% to 1.0%, V: 0% to 1.0%, Cr: 0% to 1.0%, Mo: 0% to 1.0%, Cu: 0% to 1.0%, and Ni: 0% to 1.0%)

All of these elements are elements which are effective for increasing the hardenability of the hot-formed member and stably ensuring the strength of the hot-formed member after quenching. Accordingly, one or more selected these elements may be contained. However, when each amount of Ti, Nb, and V exceeds 1.0%, it is difficult to perform hot rolling and cold rolling in the manufacturing step. In addition, when the amount of Cr, Mo, Cu, and Ni exceeds 1.0%, it is economically disadvantageous due to saturated effects obtained by the actions described above. Therefore, when each element is contained, the amount of each element is as follows. In order to more properly obtain the effects obtained by the actions, it is preferable to satisfy at least one of Ti: 0.003% or more, Nb: 0.003% or more, V: 0.003% or more, Cr: 0.003% or more, Mo: 0.003% or more, Cu: 0.003% or more and Ni: 0.003% or more.

(One or Two or More Selected from Group Consisting of Ca: 0% to 0.01%, Mg: 0% to 0.01%, REM: 0% to 0.01%, and Zr: 0% to 0.01%)

These elements are elements which are effective for contributing to the control of inclusions, particularly fine dispersing of inclusions and increasing low temperature toughness of the hot-formed member. Accordingly, one or two more selected from these elements may be contained. However, when an amount of any element exceeds 0.01%, the surface quality of the hot-formed member may be deteriorated. Therefore, when each element is contained, the amount of each element is as follows. The amount of each element to be added is preferably equal to or more than 0.0003%, in order to more properly obtain the effects obtained by the actions.

Herein, the term "REM" means a total of 17 elements formed of Sc, Y, and lanthanoid and the expression "amount of REM" means a total amount of these 17 elements. In a case of using lanthanoid as the REM, the REM is added with misch metal industrially.

(B: 0% to 0.01%)

B is an element which has an effect of increasing the low temperature toughness of the hot-formed member. Accordingly, B may be contained in the hot-formed member. However, when the B content exceeds 0.01%, the hot workability of the base steel sheet is deteriorated and it becomes difficult to perform hot rolling. Therefore, when B is contained in the hot-formed member, the B content is set to be equal to or lower than 0.01%. In order to more properly obtain the effects obtained by the actions, the B content is preferably equal to or more than 0.0003%.

(Bi: 0% to 0.01%)

Bi is an element which has an effect of preventing cracks generated when the hot-formed member is deformed. Accordingly, Bi may be contained in the hot-formed member. However, when the Bi content exceeds 0.01%, the hot workability of the base steel sheet is deteriorated and it becomes difficult to perform hot rolling. Therefore, when Bi is contained in the hot-formed member, the Bi content is set to be equal to or lower than 0.01%. In order to more properly obtain the effects obtained by the actions, the Bi content is preferably equal to or more than 0.0003%.

2. Metallographic Microstructure of Hot-Formed Member

Next, the metallographic microstructure of the hot-formed member according to the embodiment will be described. In the following description, "%" representing the amount of each metallographic microstructure means "area %", unless otherwise stated.

The configuration of the following metallographic microstructure is a configuration of a portion from an approximately ½t thickness position to an approximately ¼t thickness position and a position which is not located in a center segregation portion. The center segregation portion may have a metallographic microstructure which is different from the representative metallographic microstructure of the steel. However, the center segregation portion is a minor area with respect to the entire sheet thickness and does not substantially affect the properties of the steel. That is, the metallographic microstructure of the center segregation portion is not a representative of the metallographic microstructure of the steel. Accordingly, the metallographic microstructure of the hot-formed member according to the embodiment is defined as the microstructure of a portion from an approximately ½t thickness position to an approximately ¼t thickness position and a position which is not located in the center segregation portion. The expression "½t thickness position" indicates a position which is at a depth of ½ of a member thickness t from the surface of the hot-formed member and the expression "¼t thickness position" indicates a position which is at a depth of ¼ of the member thickness t from the surface of the hot-formed member.

(Area Ratio of Austenite: 10% to 40%)

The ductility of the hot-formed member is significantly improved by containing an appropriate amount of austenite in the steel. When the area ratio of austenite is less than 10%, it is difficult to ensure excellent ductility. Accordingly, the area ratio of austenite is set to be equal to or more than 10%. When the area ratio of austenite is equal to or more than 18%, elongation of the hot-formed member is set to be equal to or more than 21% and extremely excellent ductility is exhibited in the hot-formed member. Therefore, the area ratio of austenite is preferably equal to or more than 18%. Meanwhile, when the area ratio of austenite exceeds 40%, delayed fracture easily occurs in the hot-formed member. Accordingly, the area ratio of austenite is set to be equal to or less than 40%. The area ratio of austenite is preferably equal to or lower than 32%, in order to properly prevent occurrence of delayed fracture.

A measuring method of the area ratio of austenite is well known for a person skilled in the art and the area ratio thereof can be measured by a common method in the embodiment. In the examples which will be described later, the area ratio of the austenite is obtained by X-ray diffraction.

(Distribution of Austenite and Martensite: Total Number Density of Particles of Austenite and Martensite: 1.0 Number/$\mu m^2$ or More)

It is possible to prevent microscopic localization of plastic deformation of the hot-formed member when performing hot forming, by allowing a large amount of a fine hard microstructure to be present in the metallographic microstructure, that is, by increasing the number density of austenite and martensite in the metallographic microstructure. Accordingly, it is possible to prevent cracks generated in austenite and martensite at the time of deformation and to improve the impact properties of the hot-formed member. In order to obtain a hot-formed member having a tensile strength equal to or more than 900 MPa and having excellent impact properties, the metallographic microstructure of the hot-formed member is a metallographic microstructure in which the total amount of austenite and martensite is present at the number density of 1.0 number/$\mu m^2$ or more. In order to more properly obtain the effect of improving the impact properties described above, the lower limit value of the total number density of particles of austenite and martensite is more preferably 1.3 number/$\mu m^2$. It is preferable that the total number density of austenite particles and martensite particles be as large as possible. This is because, as the total number density of austenite particles and martensite particles becomes larger, localization of deformation is prevented and impact properties are further improved. Accordingly, the upper limit value of the total number density of austenite particles and martensite particles is not necessary to be specified. However, when considering the capability of manufacturing equipment, the substantial upper limit value of the total number density of austenite particles and martensite particles is approximately 3.0 number/$\mu m^2$.

The ratio of the number of austenite particles and the number of martensite particles is not necessary to be specified. Even when the martensite particles are not contained in the metallographic microstructure, it is possible to obtain the effect for preventing cracks described above.

The number density of the austenite particles and the martensite particles can be obtained by the following method. First, a test piece is prepared from the hot-formed member along a rolling direction and a direction orthogonal to the rolling direction of the base steel sheet which is a raw material of the hot-formed member. Then, the metallographic microstructures of a cross section of the test piece along the rolling direction and a cross section thereof orthogonal to the rolling direction are imaged by an electron microscope. The electron micrographs of a region having a size of 800 μm×800 μm obtained as described above are subjected to image analysis to calculate the number density of the austenite particles and the martensite particles. It is easy to distinguish the austenite particles and the martensite particles from the surrounding microstructures through use of an electron microscope.

It is not necessary to specify an average grain size of the austenite particles and the martensite particles. In general, when the average grain size is large, this may negatively affect the strength of steel. However, as long as when the number density described above is achieved, the grain size of the austenite particles and the martensite particles are not coarsened.

(Other Microstructures)

As a metallographic microstructure other than the austenite and the martensite described above, one or two or more of ferrite, bainite, cementite, and pearlite may be contained in the hot-formed member. The amount of ferrite, bainite, cementite, and the pearlite is not particularly specified, as long as the amount of austenite and martensite is within the range described above.

(Tensile Strength: 900 MPa to 1300 MPa)

The tensile strength of the hot-formed member according to the embodiment is equal to or greater than 900 MPa. When the hot-formed member has such a tensile strength, it is possible to achieve weight saving of various members using the steel sheet according to the embodiment. However, when the tensile strength is greater than 1300 MPa, brittle fracture easily occurs on the steel sheet. Therefore, the upper limit value of the tensile strength of the steel sheet is set to be 1300 MPa. Such tensile strength can be obtained by the chemical components described above and by manufacturing method which will be described later.

3. Manufacturing Method

Next, a preferred manufacturing method of the hot-formed member according to the embodiment having the above-mentioned properties will be described.

In order to ensure both of the tensile strength equal to or greater than 900 MPa and excellent ductility and impact properties, it is necessary that the microstructure after quenching is set as a metallographic microstructure in which the area ratio of austenite is 10 area % to 40 area % and the total number density of particles of austenite and martensite is equal to or greater than 1.0 number/$\mu m^2$ as described above.

In order to obtain such a metallographic microstructure, a base steel sheet having the same chemical composition as the chemical composition of the hot-formed member described above and having a metallographic microstructure in which total area ratio of one or both of bainite and martensite is equal to or greater than 70 area %, and particles of cementite are present at a number density equal to or greater than 1.0 number/$\mu m^2$, is heated to a temperature region which is equal to or higher than 670° C. and lower than 780° C. and is lower than an $Ac_3$ temperature in a heating step, and holding the temperature of the base steel sheet in the temperature region which is equal to or higher than 670° C. and lower than 780° C. and is lower than the $Ac_3$ temperature for 2 minutes to 20 minutes in a holding step, and performing hot pressing of the base steel sheet in a hot forming step. The expression "temperature region which is equal to or higher than 670° C. and lower than 780° C. and is lower than the $Ac_3$ temperature" indicates a "temperature region which is equal to higher than 670° C. and lower than 780° C." when the $Ac_3$ temperature is equal to or higher than 780° C., and indicates a "temperature region which is equal to higher than 670° C. and lower than the $Ac_3$ temperature" when the $Ac_3$ temperature is lower than 780° C.

In a case where the Mn content of the base steel sheet is 2.4 mass % to 8.0 mass %, the base steel sheet is cooled under conditions in which an average cooling rate in a temperature region of 600° C. to 150° C. is from 5° C./sec to 500° C./sec in a cooling step, after the hot forming step. In a case where the Mn content of the base steel sheet is equal to or more than 1.2 mass % and less than 2.4 mass %, the base steel sheet is cooled under conditions in which the average cooling rate in a temperature region of 600° C. to 500° C. is from 5° C./sec to 500° C./sec and the average cooling rate in a temperature region lower than 500° C. and equal to or higher than 150° C. is from 5° C./sec and 20° C./sec in a cooling step, after the hot forming step.

As a base steel sheet to be subjected to the hot pressing, the base steel sheet having the same chemical composition as the chemical composition of the hot-formed member described above and having a metallographic microstructure in which one or both of bainite and martensite are contained to have a total area ratio equal to or greater than 70 area % and particles of cementite are present at a number density equal to or greater than 1.0 number/$\mu m^2$ is used. This base steel sheet is, for example, a hot rolled steel sheet, a cold rolled steel sheet, a hot-dip galvanized cold rolled steel sheet, or a galvannealed cold rolled steel sheet. The base steel sheet having the metallographic microstructure is subjected to hot pressing under heat treatment conditions which will be described later, and accordingly, a hot-formed member having the metallographic microstructure described above, a tensile strength equal to or greater than 900 MPa, and excellent ductility and impact properties is obtained.

The metallographic microstructure of the base steel sheet described above is specified in a portion from an approximately ½t thickness position to an approximately ¼t thickness position and a position which is not located in the center segregation portion. A reason for specifying the configuration of the metallographic microstructure of the base steel sheet in this position is same as the reason for specifying the configuration of the metallographic microstructure of the hot-formed member of a portion from an approximately ½t thickness position to an approximately ¼t thickness position and a position which is not located in the center segregation portion.

(One or Both of Bainite and Martensite: 70 Area % or More in Total)

When the total area ratio of bainite and martensite in the base steel sheet is equal to or greater than 70%, the metallographic microstructure of the hot-formed member described above is formed in the heating step of the hot pressing which will be described later and it becomes easy to stably ensure the strength after quenching. Accordingly, the total area ratio of bainite and martensite in the base steel sheet is preferably equal to or greater than 70%. It is not necessary to set the upper limit of the total area ratio of bainite and martensite. However, the upper limit of the total area ratio is substantially approximately 99.5 area %, in order to allow particles of cementite to be present at a number density equal to or greater than 1.0 number/$\mu m^2$.

A method of measuring of each area ratio of bainite and martensite is well known for a person skilled in the art and the area ratio thereof can be measured by a common method in the embodiment. In the examples which will be described later, the area ratio of each of bainite and martensite is measured by performing image analysis of electron micrographs of the metallographic microstructure.

(Number Density of Particles of Cementite: 1.0 Number/$\mu m^2$ or More)

The particles of cementite in the base steel sheet are precipitation nuclei of austenite and martensite, at the time of heating and cooling during the hot pressing. In the metallographic microstructure of the hot-formed component, the total number density of austenite and martensite is necessarily equal to or greater than 1.0 number/$\mu m^2$, and in order to obtain such a metallographic microstructure, the particles of cementite are necessarily present in the metallographic microstructure of the base steel sheet at a number density equal to or greater than 1.0 number/$\mu m^2$. In a case where the number density of cementite in the base steel sheet is smaller than 1.0 number/$\mu m^2$, the total number density of austenite and martensite in the hot-formed member may be smaller than 1.0 number/$\mu m^2$. As the number density of particles of cementite in the base steel sheet be large, the total number density of the austenite particles and the martensite particles in the hot-formed member increase, thus it is preferable that the number density of particles of cementite in the base steel sheet is large. However, when considering the upper limit of the capability of the equipment, the substantial upper limit of the number density of the particles of cementite is approximately 3.0 number/$\mu m^2$.

The number density of cementite can be obtained by the following method. First, a test piece is prepared from the base steel sheet along a rolling direction of the base steel sheet and a direction orthogonal to the rolling direction. Then, the metallographic microstructures of a cross section of the test piece along the rolling direction and a cross section thereof orthogonal to the rolling direction are imaged by an electron microscope. The electron micrographs of a region having a size of 800×μm×800 μm imaged as described above are subjected to image analysis to calculate the number density of cementite. It is easy to distinguish the cementite particles from the surrounding microstructures using an electron microscope.

It is not necessary to specify the average grain size of the cementite particles. As long as the number density described above is achieved, the cementite which is coarse and negatively affect the steel is not precipitated.

The hot rolled steel sheet satisfying the conditions necessary for the base steel sheet of the embodiment can be manufactured, for example, by performing finish rolling with respect to an ingot having the same chemical composition as the chemical composition of the hot-formed member described above in a temperature region equal to or lower than 900° C., and rapidly cooling the steel sheet after the finish rolling to a temperature region equal to or lower than 600° C. at a cooling rate equal to or faster than 5° C./sec. The cold rolled steel sheet satisfying the conditions necessary for the base steel sheet of the embodiment can be manufactured, for example, by annealing the hot rolled steel sheet at a temperature equal to or higher than $Ac_3$ temperature and performing rapid cooling to a temperature region equal to or lower than 600° C. at an average cooling rate of equal to or faster than 5° C./sec. By performing the rapid cooling under the conditions described above, a large amount of precipitation nuclei of cementite is generated in the base steel sheet, and as a result, it is possible to obtain the base steel sheet containing cementite having the number density equal to or greater than 1.0 number/$\mu m^2$. The hot-dip galvanized cold rolled steel sheet and the galvannealed cold rolled steel sheet satisfying the conditions necessary for the base steel sheet of the embodiment can be manufactured, for example, by performing hot dip galvanizing and galvannealing with respect to the cold rolled steel sheet.

(Heating Temperature of Base Steel Sheet: Temperature Region which is Equal to or Higher than 670° C. and Lower than 780° C. and is Lower than $Ac_3$ Temperature)

(Holding Temperature and Holding Time of Base Steel Sheet: Holding in Temperature Region which is Equal to or Higher than 670° C. and Lower than 780° C. and is Lower than $Ac_3$ Temperature for 2 Minutes to 20 Minutes)

In the heating step of the base steel sheet to be subjected to the hot pressing, the base steel sheet is heated to the temperature region which is equal to or higher than 670° C. and lower than 780° C. and is lower than the $Ac_3$ temperature (° C.). In the holding step of the base steel sheet, the temperature of the base steel sheet is held in the temperature region, that is a temperature region which is equal to or higher than 670° C. and lower than 780° C. and is lower than the $Ac_3$ temperature (° C.) for 2 minutes to 20 minutes. The $Ac_3$ temperature is a temperature represented by the following Expression (i) obtained by an experiment. In a case where the steel is heated to a temperature region equal to or higher than the $Ac_3$ temperature, the metallographic microstructure of the steel becomes an austenite single phase.

$$Ac_3=910-203\times(C^{0.5})-15.2\times Ni+44.7\times Si+104\times V+31.5\times Mo-30\times Mn-11\times Cr-20\times Cu+700\times P+400\times sol.\ Al+50\times Ti \quad (i)$$

Herein, an element symbol in the expression represents the amount (unit: mass %) of each element in the chemical composition of the steel sheet. "sol. Al" represents concentration (unit: mass %) of solution Al.

In a case where the holding temperature in the holding step is lower than 670° C. and the base steel sheet contains a large amount of Si, the area ratio of the austenite in the base steel sheet before the hot pressing becomes too small and the shape accuracy of the hot-formed member after the hot forming is significantly deteriorated. Accordingly, the holding temperature in the holding step is set to be equal to or higher than 670° C. Meanwhile, when the holding temperature is equal to or higher than 780° C. or equal to or higher than the $Ac_3$ temperature, the sufficient amount of austenite is not contained in the metallographic microstructure of the hot-formed member after quenching and the ductility of the hot-formed member is significantly deteriorated. In addition, in a case where the holding temperature is equal to or higher than 780° C. or equal to or higher than the $Ac_3$ temperature, fine hard microstructure is not present in the metallographic microstructure of the hot-formed member, and this causes a deterioration in impact properties of the hot-formed member. Accordingly, the holding temperature is set to be lower than 780° C. and lower than the $Ac_3$ temperature. The holding temperature is preferably from 680° C. to 760° C. in order to more properly avoid the unpreferred phenomenon described above.

When the holding time in the holding step is shorter than 2 minutes, it is difficult to stably ensure the strength of the hot-formed member after quenching. Accordingly, the holding time is set to be equal to or longer than 2 minutes. Meanwhile, when the holding time exceeds 20 minutes, not only the productivity is suppressed, but the surface quality of the hot-formed member is deteriorated due to generation of scales or zinc based oxides. Accordingly, the holding time is set to be equal to or shorter than 20 minutes. The holding time is preferably from 3 minutes to 15 minutes in order to more properly avoid the unpreferred phenomenon described above.

A heating rate in the heating step for heating to the temperature region which is equal to or higher than 670° C. and lower than 780° C. and is lower than the $Ac_3$ temperature is not particularly necessary to be limited. However, it is preferable to heat the steel sheet at an average heating rate of 0.2° C./sec to 100° C./sec. When the average heating rate is set to be equal to or faster than 0.2° C./sec, it is possible to ensure higher productivity. In addition, when the average heating rate is set to be equal to or slower than 100° C./sec, the heating temperature is easily controlled in a case of performing the heating using a typical furnace. However, when high frequency heating or the like is used, it is possible to control the heating temperature with excellent accuracy, even when the heating is performed at a heating rate exceeding 100° C./sec.

(Average Cooling Rate in Cooling Step in a Case where Mn Content of Base Steel Sheet is 2.4 Mass % to 8.0 Mass %: 5° C./Sec to 500° C./Sec in Temperature Region of 600° C. to 150° C.)

(Average Cooling Rate in Cooling Step in a Case where Mn Content of Base Steel Sheet is Equal to or More than 1.2 Mass % and Less than 2.4 Mass %: 5° C./Sec to 500° C./Sec in a Temperature Region of 600° C. to 500° C. and 5° C./Sec to 20° C./Sec in Temperature Region which is Lower than 500° C. and Equal to or Higher than 150° C.)

In the cooling step, the cooling is performed in the temperature region of 150° C. to 600° C. so that diffusion type transformation does not occur in the hot-formed member. When the average cooling rate in the temperature region of 150° C. to 600° C. is slower than 5° C./sec, soft ferrite and pearlite are excessively generated in the hot-formed member and it is difficult to ensure the tensile strength equal to or greater than 900 MPa after quenching. Accordingly, the average cooling rate in the temperature region is set to be equal to or faster than 5° C./sec.

The upper limit value of the average cooling rate in the cooling step changes depending on the Mn content of the base steel sheet. In a case where the Mn content of the base steel sheet is 2.4 mass % to 8.0 mass %, it is not necessary to particularly limit the upper limit value of the average cooling rate. However, the average cooling rate in the temperature region of 150° C. to 600° C. hardly exceeds 500° C./sec, in the typical equipment. Accordingly, the average cooling rate in the temperature region of 150° C. to 600° C. in a case where the Mn content of the base steel sheet is 2.4 mass % to 8.0 mass % is set to be equal to or slower than 500° C./sec. In a case where the average cooling rate is excessively high, the production cost increases due to energy related to cooling, and accordingly, the average cooling rate in the temperature region of 150° C. to 600° C. in a case where the Mn content of the base steel sheet is 2.4 mass % to 8.0 mass % is preferably equal to or slower than 200° C./sec.

In a case where the Mn content of the base steel sheet is equal to or more than 1.2% and less than 2.4%, it is necessary to perform mild cooling in the temperature region which is lower than 500° C. and equal to or higher than 150° C., in order to improve the ductility of the hot-formed member. In a case where the Mn content of the base steel sheet is equal to or more than 1.2% and less than 2.4%, specifically, it is necessary to perform cooling in the temperature region which is lower than 500° C. and equal to or higher than 150° C. at the average cooling rate of 5° C./sec to 20° C./sec, and more specifically, it is preferable to control the cooling rate as described later.

In the hot pressing, generally, a die having room temperature or several tens ° C. immediately before the hot pressing takes heat from the hot-formed member, and accordingly, the cooling of the hot-formed member is performed. Accordingly, a size of the die may be changed to change heat capacity of a steel die, in order to change the cooling rate. In a case where the die size cannot be changed, it is also possible to change the cooling rate by changing a flow rate of a cooling medium using a fluid cooling type die. In addition, it is also possible to change the cooling rate by allowing a cooling medium (water or gas) to flow through grooves during pressing using a die having a plurality of grooves provided in advance. In addition, it is also possible to change the cooling rate by operating a pressing machine during the pressing to separate the die and the hot-formed member and by allowing gas flow between both items. Furthermore, it is also possible to change the cooling rate by die clearance to change a contact area between the die and the steel sheet (hot-formed member). With the above description, the following measures are considered as a way which changes the cooling rate at approximately 500° C.

(1) A way in which the cooling rate is changed by moving the hot-formed member into a die having different heat capacity or a die heated to a temperature exceeding 100° C., immediately after the temperature reaches 500° C.;

(2) a way in which the cooling rate is changed by changing a flow rate of a cooling medium in a die immediately after the temperature reaches 500° C., in a case of a fluid cooling type die; and (3) To change the cooling rate by operating a pressing machine to separate the die and the hot-formed member and by allowing gas flow between both items and changing the flow rate of the gas, immediately after the temperature reaches 500° C.

The type of the forming performed by the hot pressing method of the embodiment is not particularly limited. Exemplary examples of the forming include bending, drawing, stretching, hole expending, or flanging. The forming type described above may be preferably selected depending on the desired type or shape of the hot-formed member. Representative examples of the hot-formed member can include a door guard bar and a bumper reinforcement, which are reinforcing components for a vehicle. For example, in a case where the hot-formed member is a bumper reinforcement, the hot-formed member which is a galvannealed steel sheet having a predetermined length may be prepared and may be sequentially subjected to bending or the like in a die under the conditions described above.

In the above description, the hot forming has been described as an example of the hot pressing which is a specific type, but the manufacturing method according to the embodiment is not limited to hot pressing. The manufacturing method according to the embodiment can be applied to various hot forming including means for cooling the steel sheet at the same time as the forming or immediately after the forming, in the same manner as in the case of the hot pressing. As such hot forming, roll forming is used, for example.

The hot-formed member according to the embodiment has excellent ductility and impact properties. It is preferable that the hot-formed member according to the embodiment have ductility so that the total elongation obtained by a tensile test is equal to or greater than 15%. It is more preferable that the total elongation of the hot-formed member according to the embodiment obtained by a tensile test is equal to or greater than 18%. It is most preferable that the total elongation of the hot-formed member according to the embodiment obtained by a tensile test is equal to or greater than 21%. Meanwhile, it is preferable that the hot-formed member according to the embodiment has impact properties so that an impact value obtained by a Charpy test at 0° C. is equal to or greater than 20 J/cm$^2$. The hot-formed member having such properties is realized by satisfying the configuration described above relating to the chemical composition and the metallographic microstructure.

After performing hot forming such as hot pressing, shot blast treatment is generally performed with respect to the hot-formed member in order to remove scales. This shot blast treatment has an effect of introducing compressive stress to the surface of a treated material. Accordingly, the shot blast treatment performed with respect to the hot-formed member is advantageous for preventing delayed fracture in the hot-formed member and improving fatigue strength of the hot-formed member.

EXAMPLES

Hereinafter, examples of the present invention will be described.

Steel sheets having chemical composition shown in Table 1 and the sheet thickness and the metallographic microstructure shown in Table 2 were used as base steel sheets.

TABLE 1

| | Chemical composition (unit: mass %, balance: Fe and impurities) | | | | | | | | $Ac_3$ |
|---|---|---|---|---|---|---|---|---|---|
| Steel | C | Si | Mn | P | S | sol. Al | N | Other elements | (° C.) |
| A | 0.21 | 1.72 | 3.15 | 0.009 | 0.0014 | 0.036 | 0.0043 | | 820 |
| B | 0.07 | 1.76 | 5.25 | 0.012 | 0.0013 | 0.029 | 0.0043 | Ca = 0.0013 | 796 |
| C | 0.21 | 1.65 | 2.48 | 0.013 | 0.0012 | 0.122 | 0.0035 | REM = 0.0021 | 873 |
| D | 0.01 | 1.78 | 6.82 | 0.011 | 0.0013 | 0.029 | 0.0047 | | 780 |
| E | 0.10 | 1.89 | 2.53 | 0.014 | 0.0014 | 0.032 | 0.0046 | Ni = 0.72 | 867 |
| F | 0.09 | 2.05 | 4.95 | 0.012 | 0.0013 | 0.028 | 0.0041 | Mg = 0.0009, Bi = 0.0021 | 811 |
| G | 0.19 | 1.73 | 1.68 | 0.013 | 0.0012 | 0.038 | 0.0039 | | 873 |
| H | 0.10 | 1.43 | 4.26 | 0.009 | 0.0012 | 0.028 | 0.0046 | Cu = 0.32, Ni = 0.45, Zr = 0.0012 | 787 |
| I | 0.10 | 2.02 | 4.84 | 0.011 | 0.0011 | 0.029 | 0.0048 | V = 0.024, B = 0.0007 | 813 |
| J | 0.13 | 1.81 | 4.68 | 0.009 | 0.0009 | 0.030 | 0.0044 | | 796 |
| K | 0.52 | 1.26 | 3.13 | 0.011 | 0.0011 | 0.028 | 0.0045 | | 745 |
| L | 0.15 | 1.89 | 4.64 | 0.012 | 0.0014 | 0.031 | 0.0045 | Ti = 0.015, Nb = 0.022, Cr = 0.43 | 793 |
| M | 0.10 | 1.98 | 4.97 | 0.010 | 0.0011 | 0.028 | 0.0041 | | 803 |
| N | 0.23 | 1.43 | 1.02 | 0.012 | 0.0012 | 0.037 | 0.0041 | | 869 |
| O | 0.11 | 1.52 | 4.42 | 0.011 | 0.0009 | 0.232 | 0.0042 | Mo = 0.12 | 881 |
| P | 0.12 | 0.81 | 3.23 | 0.013 | 0.0012 | 0.032 | 0.0042 | | 801 |
| Q | 0.21 | 0.48 | 3.22 | 0.012 | 0.0011 | 0.028 | 0.0041 | | 761 |
| R | 0.11 | 3.21 | 3.25 | 0.014 | 0.0016 | 0.034 | 0.0037 | | 912 |
| S | 0.14 | 1.54 | 8.12 | 0.012 | 0.0013 | 0.032 | 0.0039 | | 680 |
| T | 0.12 | 0.55 | 5.43 | 0.011 | 0.0012 | 1.854 | 0.0043 | | 1449 |
| U | 0.11 | 0.89 | 4.85 | 0.014 | 0.0013 | 2.121 | 0.0042 | | 1595 |

TABLE 2

| | | Base steel sheet | | | | |
|---|---|---|---|---|---|---|
| Sample No. | Steel | Steel sheet | Thickness (mm) | Microstructure | Total area ratio of bainite and martensite (%) | Density of cementite (number/μm$^2$) |
| 1 | A | Cold rolled steel sheet | 1.6 | Bainite, Martensite | 93 | 1.3 |
| 2 | B | Hot rolled steel sheet | 2.3 | Martensite | 99 | 1.8 |
| 3 | C | Galvannealed steel sheet | 1.6 | Bainite, Martensite | 93 | 1.1 |
| 4 | C | Galvannealed steel sheet | 1.6 | Bainite, Martensite | 100 | 1.0 |
| 5 | C | Hot rolled steel sheet | 2.3 | Ferrite, Pearlite | 0 | 0.2 |
| 6 | C | Hot rolled steel sheet | 2.3 | Bainite, Martensite | 97 | 0.8 |
| 7 | D | Cold rolled steel sheet | 1.6 | Bainite, Martensite | 100 | 1.1 |
| 8 | E | Hot rolled steel sheet | 2.3 | Ferrite, Bainite, Martensite | 95 | 1.4 |
| 9 | F | Cold rolled steel sheet | 1.4 | Bainite, Martensite | 99 | 2.1 |
| 10 | F | Hot-dip galvanized steel sheet | 1.4 | Ferrite, Bainite, Martensite | 62 | 1.2 |
| 11 | G | Hot-dip galvanized steel sheet | 1.4 | Bainite | 98 | 1.2 |
| 12 | G | Hot-dip galvanized steel sheet | 1.4 | Bainite | 100 | 1.1 |
| 13 | H | Hot rolled steel sheet | 2.3 | Bainite, Martensite | 99 | 1.4 |
| 14 | H | Hot rolled steel sheet | 2.3 | Bainite, Martensite | 100 | 1.3 |
| 15 | I | Hot rolled steel sheet | 2.3 | Martensite | 99 | 1.5 |
| 16 | I | Hot rolled steel sheet | 2.3 | Martensite | 100 | 1.3 |
| 17 | I | Hot rolled steel sheet | 2.3 | Martensite | 99 | 1.6 |
| 18 | J | Hot rolled steel sheet | 2.3 | Bainite, Martensite | 98 | 1.7 |
| 19 | K | Hot rolled steel sheet | 2.3 | Martensite | 95 | 1.5 |
| 20 | L | Hot rolled steel sheet | 2.3 | Bainite, Martensite | 98 | 1.6 |
| 21 | M | Hot rolled steel sheet | 2.3 | Bainite, Martensite | 99 | 1.7 |
| 22 | M | Hot rolled steel sheet | 2.3 | Bainite, Martensite | 100 | 1.4 |
| 23 | M | Hot rolled steel sheet | 2.3 | Bainite, Martensite | 100 | 1.3 |
| 24 | N | Hot rolled steel sheet | 2.3 | Bainite, Martensite | 98 | 1.1 |

TABLE 2-continued

| Sample No. | Steel | Base steel sheet: Steel sheet | Thickness (mm) | Microstructure | Total area ratio of bainite and martensite (%) | Density of cementite (number/μm²) |
|---|---|---|---|---|---|---|
| 25 | O | Hot rolled steel sheet | 2.3 | Bainite, Martensite | 99 | 1.6 |
| 26 | P | Cold rolled steel sheet | 1.6 | Bainite, Martensite | 98 | 1.2 |
| 27 | Q | Hot rolled steel sheet | 2.3 | Bainite, Martensite | 98 | 1.2 |
| 28 | R | Hot rolled steel sheet | 2.3 | Bainite, Martensite | 97 | 1.4 |
| 29 | S | Hot rolled steel sheet | 2.3 | Martensite | 96 | 1.3 |
| 30 | T | Hot rolled steel sheet | 2.3 | Bainite, Martensite | 99 | 1.6 |
| 31 | U | Hot rolled steel sheet | 2.3 | Bainite, Martensite | 99 | 1.5 |
| 32 | G | Hot-dip galvanized steel sheet | 1.4 | Bainite | 100 | 1.3 |

These base steel sheets are steel sheets manufactured by performing hot rolling of a slab welded in a laboratory (shown as hot rolled steel sheet in Table 2) or steel sheets manufactured by performing cold rolling and recrystallization annealing of the hot rolled steel sheet (shown as cold rolled steel sheet in Table 2). Using a plating simulator, some steel sheets were subjected to a hot-dip galvanizing treatment (plating deposition amount per one surface is 60 g/m²) or galvannealing treatment (plating deposition amount per one surface is 60 g/m², the Fe content in the plated film is 15 mass %). In Table 2, the steel sheets are respectively shown as a hot-dip galvanized steel sheet and a galvannealed steel sheet. In addition, steel sheets as cold rolled (shown as "full-hard" in Table 2) steel sheets are also used.

These steel sheets were cut to have a width of 100 mm and a length of 200 mm and heated and cooled under the conditions shown in Table 3. A thermocouple was attached to the steel sheet and the cooling rate was measured. The "average heating rate" of Table 3 indicates the average heating rate in a temperature region from room temperature to 670° C. The "holding time" shown of Table 3 indicates time for which the steel sheet was held in the temperature region equal to or higher than 670° C. The "cooling rate *1" of Table 3 indicates the average cooling rate in the temperature region from 600° C. to 500° C. and the "cooling rate *2" indicates the average cooling rate in the temperature region from 500° C. to 150° C. The steel sheets obtained under various manufacturing conditions were subjected to metallographic microstructure observation, X-ray diffraction measurement, a tensile test, and a Charpy test.

TABLE 3

| Sample No. | Steel | Average heating rate (° C./s) | $Ac_3$ point | Heating temperature (° C.) | Heating time (min) | Cooling rate *1 (° C./s) | Cooling rate *2 (° C./s) |
|---|---|---|---|---|---|---|---|
| 1 | A | 12 | 820 | 700 | 10 | 70 | 70 |
| 2 | B | 12 | 796 | 710 | 10 | 50 | 50 |
| 3 | C | 11 | 873 | 720 | 10 | 25 | 25 |
| 4 | C | 12 | 873 | 720 | 10 | 3 | 3 |
| 5 | C | 12 | 873 | 700 | 10 | 25 | 25 |
| 6 | C | 11 | 873 | 720 | 10 | 25 | 25 |
| 7 | D | 13 | 780 | 680 | 10 | 80 | 80 |
| 8 | E | 10 | 867 | 700 | 10 | 90 | 90 |
| 9 | F | 10 | 811 | 700 | 10 | 80 | 80 |
| 10 | F | 10 | 811 | 680 | 10 | 50 | 50 |
| 11 | G | 12 | 873 | 700 | 10 | 15 | 15 |
| 12 | G | 13 | 873 | 700 | 10 | 70 | 70 |
| 13 | H | 15 | 787 | 700 | 10 | 80 | 80 |
| 14 | H | 15 | 787 | 800 | 10 | 70 | 70 |
| 15 | I | 11 | 813 | 700 | 10 | 50 | 50 |
| 16 | I | 11 | 813 | 790 | 10 | 60 | 60 |
| 17 | I | 11 | 813 | 660 | 10 | 50 | 50 |
| 18 | J | 12 | 796 | 690 | 10 | 40 | 40 |
| 19 | K | 13 | 745 | 700 | 10 | 80 | 80 |
| 20 | L | 11 | 793 | 700 | 10 | 50 | 50 |
| 21 | M | 10 | 803 | 700 | 10 | 60 | 60 |
| 22 | M | 10 | 803 | 680 | 1.5 | 60 | 60 |
| 23 | M | 10 | 803 | 690 | 25 | 60 | 60 |
| 24 | N | 11 | 869 | 730 | 10 | 20 | 20 |
| 25 | O | 13 | 881 | 700 | 10 | 60 | 60 |
| 26 | P | 12 | 801 | 700 | 10 | 30 | 30 |
| 27 | Q | 11 | 761 | 700 | 10 | 70 | 70 |
| 28 | R | 10 | 912 | 770 | 10 | 70 | 70 |
| 29 | S | 10 | 680 | 670 | 10 | 70 | 70 |
| 30 | T | 12 | 1,449 | 750 | 10 | 80 | 80 |

TABLE 3-continued

| Sample No. | Steel | Average heating rate (° C./s) | $Ac_3$ point | Heating temperature (° C.) | Heating time (min) | Cooling rate *1 (° C./s) | Cooling rate *2 (° C./s) |
|---|---|---|---|---|---|---|---|
| 31 | U | 10 | 1,595 | 680 | 10 | 70 | 70 |
| 32 | G | 13 | 873 | 700 | 10 | 80 | 7 |

*1 Average cooling rate from 600° C. to 500° C.
*2 Average cooling rate from 500° C. to 150° C.

Samples prepared in the examples and comparative examples were not subjected to the hot pressing using a die, but subjected to the same thermal history as that of the hot-formed member. Accordingly, the mechanical properties of the samples are substantially the same as those of the hot-formed member having the same thermal history.

(Microstructure of Base Steel Sheet)

A test piece was prepared from the heat-treated sample along the rolling direction of the base steel sheet and the direction orthogonal to the rolling direction of the base steel sheet. Then, the metallographic microstructures of a cross section of the test piece along the rolling direction and a cross section thereof orthogonal to the rolling direction were imaged by an electron microscope. The electron micrographs of a region having a total size of 0.01 $mm^2$ obtained as described above are subjected to image analysis to identify the metallographic microstructure and measure the total area ratio of bainite and martensite. In addition, the electron micrographs of a region having a size of 800 μm×800 μm obtained by imaging the samples described above with an electron microscope were subjected to image analysis to calculate the number density of the cementite particles.

(Distribution State of Austenite and Martensite of Heat-Treated Sample)

A test piece was prepared from the heat-treated sample along the rolling direction of the base steel sheet and the direction orthogonal to the rolling direction of the base steel sheet. Then, the metallographic microstructures of a cross section of the test piece along the rolling direction and a cross section thereof orthogonal to the rolling direction are imaged by an electron microscope. The electron micrographs of a region having a size of 800 μm×800 μm obtained as described above were subjected to image analysis to calculate the number density of the austenite particles and the martensite particles.

(Area Ratio of Austenite of Heat-Treated Sample)

A test piece having a width of 25 mm and a length of 25 mm was cut from each heat-treated sample and a thickness thereof is reduced by 0.3 mm by performing chemical polishing with respect to the surface of the test piece. The X-ray diffraction was performed with respect to the surface of the test piece after the chemical polishing and a profile obtained as described above was analyzed to obtain the area ratio of residual austenite. This X-ray diffraction was repeated total three times and a value obtained by averaging the obtained area ratios is shown in the table as the "area ratio of austenite".

(Tensile Test)

JIS No. 5 tensile test piece was prepared from each heat-treated sample so that the load axis was orthogonal to the rolling direction and the tensile strength (TS) and the total elongation (EL) was measured. The samples in which the tensile strength was smaller than 900 MPa and the samples in which the total elongation was less than 15% were determined to be "poor".

(Impact Properties)

A V notch test piece having a thickness of 1.2 mm was manufactured by machining the heat-treated sample. The four notch test pieces were laminated, screwed, and subjected to a Charpy impact test. A V notch direction was parallel to the rolling direction. When the impact value at 0° C. was equal to or greater than 20 $J/cm^2$, the impact properties were determined to be "excellent".

(Other Properties)

Descaling of the heat-treated samples is performed, and then, presence or absence of residual scales in the surface of the sample was confirmed. The sample in which the residual scales were present, was determined as the comparative example in which surface quality is not good. In addition, the heat-treated samples were dipped in 0.1 N hydrochloric acid to confirm whether or not the delayed fracture occurred. The sample in which the delayed fracture occurred, was determined as the comparative example in which delayed fracture resistance is not good.

(Description of Test Results)

Results of the test obtained by simulating the hot pressing are shown in Table 4.

The underlined numerical values in Tables 1 to 4 indicate that the content, conditions, or the mechanical properties shown by the numerical values are beyond the range of the present invention.

TABLE 4

| | | Hot-formed member | | | | | |
|---|---|---|---|---|---|---|---|
| Sample No. | Steel | Area ratio of austenite (%) | Total number density of austenite and martensite (number/$\mu m^2$) | TS (MPa) | EL (%) | Impact properties | Note |
| 1 | A | 12 | 1.8 | 1026 | 18 | Excellent | Invention Example |
| 2 | B | 18 | 1.9 | 953 | 28 | Excellent | Invention Example |
| 3 | C | 12 | 1.3 | 1023 | 19 | Excellent | Invention Example |
| 4 | C | 11 | 1.2 | 832 | 21 | Excellent | Comparative Example |
| 5 | C | 15 | 0.3 | 1004 | 20 | Poor | Comparative Example |
| 6 | C | 13 | 0.9 | 1023 | 19 | Poor | Comparative Example |
| 7 | D | 12 | 1.3 | 768 | 19 | Excellent | Comparative Example |

TABLE 4-continued

| Sample No. | Steel | Hot-formed member: Area ratio of austenite (%) | Total number density of austenite and martensite (number/μm²) | TS (MPa) | EL (%) | Impact properties | Note |
|---|---|---|---|---|---|---|---|
| 8 | E | 12 | 1.5 | 946 | 19 | Excellent | Invention Example |
| 9 | F | 21 | 2.2 | 1083 | 24 | Excellent | Invention Example |
| 10 | F | 17 | 1.5 | 885 | 26 | Excellent | Comparative Example |
| 11 | G | 13 | 1.3 | 943 | 18 | Excellent | Invention Example |
| 12 | G | 4 | 1.2 | 1012 | 13 | Excellent | Comparative Example |
| 13 | H | 21 | 1.9 | 1108 | 25 | Excellent | Invention Example |
| 14 | H | 3 | 0 | 1297 | 6 | Poor | Comparative Example |
| 15 | I | 15 | 1.6 | 1153 | 21 | Excellent | Invention Example |
| 16 | I | 7 | 0.1 | 1242 | 10 | Poor | Comparative Example |
| 17 | I | 8 | 1.2 | 943 | 14 | Excellent | Comparative Example |
| 18 | J | 14 | 2.1 | 1163 | 18 | Excellent | Invention Example |
| 19 | K | 25 | 1.6 | 1345 | 21 | Poor | Comparative Example |
| 20 | L | 19 | 1.8 | 1213 | 21 | Excellent | Invention Example |
| 21 | M | 20 | 2.2 | 1073 | 26 | Excellent | Invention Example |
| 22 | M | 13 | 1.5 | 893 | 27 | Excellent | Comparative Example |
| 23 | M | 21 | 1.6 | 1082 | 25 | Excellent | Comparative Example *1 |
| 24 | N | 11 | 1.1 | 821 | 23 | Excellent | Comparative Example |
| 25 | O | 18 | 1.8 | 1123 | 24 | Excellent | Invention Example |
| 26 | P | 15 | 1.4 | 1013 | 16 | Excellent | Invention Example |
| 27 | Q | 7 | 1.2 | 1046 | 13 | Excellent | Comparative Example |
| 28 | R | 18 | 1.5 | 984 | 24 | Excellent | Comparative Example *1 |
| 29 | S | 24 | 1.5 | 1297 | 18 | Excellent | Comparative Example *2 |
| 30 | T | 17 | 1.7 | 1042 | 20 | Excellent | Invention Example |
| 31 | U | 18 | 1.6 | 907 | 29 | Excellent | Comparative Example *1 |
| 32 | G | 13 | 1.3 | 1006 | 21 | Excellent | Invention Example |

*1 Scales are not peeled.
*2 Delayed fracture occurs while being dipped in 0.1N hydrochloric acid.

Sample Nos. 1 to 3, 8, 9, 11, 13, 15, 18, 20, 21, 25, 26, 30, and 32 which are present invention examples of Table 4 have a high tensile strength equal to or greater than 900 MPa and excellent ductility and impact properties. In the samples which are present invention examples, no residual scales were present after descaling, that is, excellent surface quality was obtained, and cut cross section was not cracked during the dipping in hydrochloric acid, that is, excellent delayed fracture resistance was obtained.

Meanwhile, regarding the sample No. 4, a cooling rate was beyond the range regulated in the present invention, thus the desired tensile strength was not obtained. Regarding the sample Nos. 5 and 6, a metallographic microstructure of a base steel sheet is beyond the range regulated in the present invention, thus impact properties are poor.

Regarding the sample Nos. 7 and 24, a chemical composition was beyond the range regulated in the present invention, thus desired tensile strength was not obtained.

Regarding the sample No. 10, a metallographic microstructure of a base steel sheet was beyond the range regulated in the present invention, thus the desired tensile strength was not obtained.

Regarding the sample No. 12, a cooling rate was beyond the range regulated in the present invention, thus the ductility was poor. Regarding the sample Nos. 14 and 16, a heating temperature was beyond the range regulated in the present invention, thus the ductility and the impact properties were poor.

Regarding the sample No. 17, a heating temperature was beyond the range regulated in the present invention, thus the ductility is poor.

Regarding the sample No. 19, a chemical composition was beyond the range regulated in the present invention, thus the impact property was poor.

Regarding the sample No. 22, a holding time was beyond the range regulated in the present invention, thus the desired tensile strength was not obtained.

Regarding the sample No. 27, a chemical composition was beyond the range regulated in the present invention, thus the ductility was poor.

The sample No. 23 is an example in which a holding time was beyond the range regulated in the present invention and the sample Nos. 28 and 31 are examples in which chemical compositions were beyond the range regulated in the present invention. In these samples, the tensile strength, the total elongation, and the impact properties were excellent, but residual scales were present after descaling and surface qualities were poor. Since the sample No. 29 had a chemical composition which was beyond the range regulated in the present invention, the delayed fracture occurs when performing dipping in 0.1 N hydrochloric acid and it was determined that the delayed fracture resistance was poor.

In addition, among the steel sheets of the present invention examples, the sample Nos. 1 to 3, 7 to 9, 11, 13, 15, 17, 19, and 21 have a Si content in the preferred range and the ductility thereof ware more excellent. Among those, the sample Nos. 2, 8, 11, 17, 19, and 21 have an area ratio of austenite in the preferred range and the ductility thereof was more excellent.

The invention claimed is:

1. A hot-formed member having a chemical composition comprising, by mass %,

C: 0.05% to 0.40%,
Si: 0.5% to 3.0%,
Mn: 1.2% to 8.0%,
P: 0.05% or less,
S: 0.01% or less,
sol. Al: 0.001% to 2.0%,
N: 0.01% or less, Ti: 0% to 1.0%,
Nb: 0% to 1.0%,
V: 0% to 1.0%,
Cr: 0% to 1.0%,
Mo: 0% to 1.0%,
Cu: 0% to 1.0%,
Ni: 0% to 1.0%,
Ca: 0% to 0.01%,
Mg: 0% to 0.01%,
REM: 0% to 0.01%,
Zr: 0% to 0.01%,
B: 0% to 0.01%,
Bi: 0% to 0.01%, and
the balance of Fe and impurities,
wherein the hot-formed member has a metallographic microstructure which contains an austenite of 10 area % to 40 area % and in which the total number density of particles of the austenite and particles of a martensite is equal to or greater than 1.0 piece/$\mu m^2$, and
wherein a tensile strength is 900 MPa to 1300 MPa.

2. The hot-formed member according to claim 1,
wherein the chemical composition includes one or two or more selected from the group consisting of, by mass %,
Ti: 0.003% to 1.0%,
Nb: 0.003% to 1.0%,
V: 0.003% to 1.0%,
Cr: 0.003% to 1.0%,
Mo: 0.003% to 1.0%,
Cu: 0.003% to 1.0%, and
Ni: 0.003% to 1.0%.

3. The hot-formed member according to claim 2,
wherein the chemical composition includes one or two more selected from the group consisting of, by mass %,
Ca: 0.0003% to 0.01%,
Mg: 0.0003%, to 0.01%,
REM: 0.0003% to 0.01%, and
Zr: 0.0003% to 0.01%.

4. The hot-formed member according to claim 2,
wherein the chemical composition includes, by mass %,
B: 0.0003% to 0.01%.

5. The hot-formed member according to claim 2,
wherein the chemical composition includes, by mass %,
Bi: 0.0003% to 0.01%.

6. The hot-formed member according to claim 1,
wherein the chemical composition includes one or two or more selected from the group consisting of, by mass %,
Ca: 0.0003% to 0.01%,
Mg: 0.0003% to 0.01%,
REM: 0.0003% to 0.01%, and
Zr: 0.0003% to 0.01%.

7. The hot-formed member according to claim 1,
wherein the chemical composition includes, by mass %,
B: 0.0003% to 0.01%.

8. The hot-formed member according to claim 1,
wherein the chemical composition includes, by mass %,
Bi: 0.0003% to 0.01%.

9. A manufacturing method of a hot-formed member, the method comprising:
heating a base steel sheet having a chemical composition which is same as the chemical composition of the hot-formed member according to claim 1 and in which a Mn content is 2.4 mass % to 8.0 mass %, and having a metallographic microstructure in which the total area ratio of one or both of a bainite and a martensite is equal to or greater than 70 area %, and particles of a cementite are present at a number density equal to or greater than 1.0 number/$\mu m^2$, to a temperature region which is equal to or higher than 670° C. and lower than 780° C. and is lower than an $Ac_3$ temperature;
then holding the temperature of the base steel sheet in the temperature region which is equal to or higher than 670° C. and lower than 780° C. and is lower than an $Ac_3$ temperature for 2 minutes to 20 minutes;
then performing a hot forming with respect to the base steel sheet; and
then cooling the base steel sheet under conditions in which an average cooling rate in a temperature region of 600° C. to 150° C. is from 5° C./sec to 500° C./sec.

10. A manufacturing method of a hot-formed member, the method comprising:
heating a base steel sheet having a chemical composition which is same as the chemical composition of the hot-formed member according to claim 1 and in which a Mn content equal to or more than 1.2 mass % and less than 2.4 mass %, and having a metallographic microstructure in which the total area ratio of one or both of a bainite and a martensite is equal to or greater than 70 area %, and particles of a cementite are present at a number density equal to or greater than 1.0 number/$\mu m^2$, to a temperature region which is equal to or higher than 670° C. and lower than 780° C. and is lower than an $Ac_3$ temperature;
then holding the temperature of the base steel sheet in the temperature region which is equal to or higher than 670° C. and lower than 780° C. and is lower than an $Ac_3$ temperature for 2 minutes to 20 minutes;
then performing a hot forming with respect to the base steel sheet; and
then cooling the base steel sheet under conditions in which an average cooling rate in a temperature region of 600° C. to 500° C. is from 5° C./sec to 500° C./sec and the average cooling rate in a temperature region lower than 500° C. and equal to or higher than 150° C. is from 5° C./sec and 20° C./sec.

* * * * *